US006883409B1

(12) United States Patent
Spix et al.

(10) Patent No.: US 6,883,409 B1
(45) Date of Patent: Apr. 26, 2005

(54) DEVICE FOR CROSS/CUTTING MATERIAL STRIPS, IN PARTICULAR CARDBOARD STRIPS

(75) Inventors: Guido Spix, Kaarst (DE); Albert Stitz, Kürten (DE); Frank Schmid, Krefeld (DE); Wolfgang Lange, Goch (DE)

(73) Assignee: Jagenberg Querschneider GmbH, Neuss (DE)

( * ) Notice: Subject to any disclaimer, the term of this patent is extended or adjusted under 35 U.S.C. 154(b) by 0 days.

(21) Appl. No.: 10/110,485

(22) PCT Filed: Sep. 1, 2000

(86) PCT No.: PCT/EP00/08534

§ 371 (c)(1),
(2), (4) Date: May 31, 2002

(87) PCT Pub. No.: WO01/21517

PCT Pub. Date: Mar. 29, 2001

(30) Foreign Application Priority Data

Sep. 21, 1999 (DE) ..... 199 45 114

(51) Int. Cl.[7] ..... B26B 5/20

(52) U.S. Cl. ..... 83/155.1; 83/29; 83/90; 83/100; 83/110; 271/202; 198/419.2; 414/793.3

(58) Field of Search ..... 83/436.1, 90, 106, 83/92.1, 155.1, 167, 105, 86, 110, 111, 155, 29, 100; 271/202, 204, 270; 414/788.1, 789.8, 791.5, 793.3; 198/418.6, 418.7, 419.2, 792, 804

(56) References Cited

U.S. PATENT DOCUMENTS

| | | | | | |
|---|---|---|---|---|---|
| 2,971,414 | A | * | 2/1961 | Owen | 83/75 |
| 3,477,323 | A | * | 11/1969 | Osborn | 83/79 |
| 3,498,165 | A | * | 3/1970 | Austin | 83/18 |
| 3,550,493 | A | * | 12/1970 | Benbenek | 83/64 |
| 3,724,840 | A | * | 4/1973 | Kuckhermann | 271/182 |
| 4,189,339 | A | * | 2/1980 | Loeffler et al. | 156/263 |
| 4,548,404 | A | * | 10/1985 | Brandt et al. | 271/303 |
| 5,054,763 | A | * | 10/1991 | Achelpohl et al. | 271/182 |
| 5,081,821 | A | * | 1/1992 | Meives | 53/466 |
| 5,160,132 | A | * | 11/1992 | Hanada | 271/258.01 |
| 5,166,735 | A | * | 11/1992 | Malachowski | 399/68 |
| 5,221,079 | A | * | 6/1993 | Most et al. | 271/202 |
| 5,257,777 | A | * | 11/1993 | Kalika et al. | 271/35 |
| 5,265,863 | A | * | 11/1993 | Becker | 271/183 |

FOREIGN PATENT DOCUMENTS

| | | |
|---|---|---|
| DE | 41 19 511 | 12/1992 |
| EP | 0 733 448 | 9/1996 |
| GB | 973 369 | 10/1964 |

* cited by examiner

*Primary Examiner*—Timothy V. Eley
*Assistant Examiner*—Phong Nguyen
(74) *Attorney, Agent, or Firm*—Herbert Dubno

(57) ABSTRACT

A device for cross cutting a cardboard web in which, both the blade drums, a sheet transport conveyor accelerates the sheets and then the sheets are positioned to shingle the sheets on a further conveyor. The sheet transport conveyor has a rerouting roller at the outlet side of its upper pass and then extends downwardly into a sheet discharge gate through which defective sheets are effected.

9 Claims, 3 Drawing Sheets

DEVICE FOR CROSS/CUTTING MATERIAL STRIPS, IN PARTICULAR CARDBOARD STRIPS

CROSS REFERENCE TO RELATED APPLICATIONS

This is a national stage of PCT/EP 00/08534 filed 1 Sep. 2000 and is based upon German national application 199 45 114 of 21 Sep. 1999 under the International Convention.

FIELD OF THE INVENTION

The invention relates to a device for cross-cutting webs of material, especially cardboard webs, with a cross-cutting device containing two blade drums fitted with transverse blades and with a sheet transport arrangement disposed behind the cross-cutting device and which includes a belt conveyor for accelerating the sheets produced by the transverse cutting and a braking and overlapping unit connected thereto in which a shingled stream of the sheets is produced.

STATE OF THE ART

Cross-cutting devices which produce the individual sheets from a paper web or a cardboard web by cross-cutting and which then deposit the sheets in a stack, include in known manner behind the transverse cutting device a sheet transport unit which begins with a rapid belt conveyor. By means of the rapid belt conveyor the web on cross-cutting is stretched and the cut sheets are accelerated so that a gap between the sheets will result. The gaps are required so that a brake device which follows can engage the individual sheet rear edges. In the braking of a sheet, the leading edge of the yet unbraked subsequent sheet shifts over the rear edge of the previous sheet. Thus a shingled stream of sheets arranged overlappingly can be produced which can then be deposited in a stack in a subsequent stacking unit. A cross-cutting device of this type is described in DE-A 41 19 511,.

OBJECT OF THE INVENTION

The invention presents as its object to so improve a crosscutting device of the type described so that it has a structurally simplified construction with a reduced length.

This object is achieved with an apparatus for cross cutting of webs of material (1), especially cardboard webs, which comprises:

- a cross-cutter device which includes two blade drums with transverse blades and
- a sheet transport device arranged behind the cross-cutter device and including a belt conveyor for accelerating the sheets produced by cross cutting and a brake and overlapping device following the belt conveyor, in which a shingled stream of sheets is produced. According to the invention, the transport device begins with a lower belt conveyor whose upper conveying pass is bounded on its outlet side by a rerouting roller. An ejection roller feeds a sheet to a subsequent path region in which it is briefly not engaged and bounds the inlet of a sheet gate whereby the downwardly deflected belt of the belt conveyor functions also as a conveyor in the sheet gate.

With the cross-cutting device according to the invention, the sheet transport unit begins with a rapid belt conveyor which is preferably is very short. A sheet is briefly accelerated and then immediately released so that by its braking, the overlapping process can be instituted. The gap drawn between two successive sheets is held as small as possible.

Directly behind the outlet side rerouting roller of the rapid belt conveyor there is found the inlet of a sheet gate. For the gate inlet, no interruption of the belt conveyor is required. This enables the length of the transport unit and thus the length of the overall cross-cutter device to be reduced significantly.

The spacing of the outlet side rerouting roller from the rotation axes of the blade drums can be less than the maximum size length, preferably less than the minimum size length of the sheets. Above the lower belt conveyor a capturing roller can be arranged which forms with the conveying pass of the belt conveyor a clamping gap. The capturing roller can be simultaneously the inlet side rerouting roller of an upper belt conveyor which extends at least over the region of the maximum sheet size length. A further slower belt conveyor can be disposed behind the lower belt conveyor and extends up to a stacking device and can form with the capturing roller a clamping gap which bounds the region of the path of the sheet in which the sheet is not gripped. The braking and overlapping device can begin with an element for the downward movement of the rear edges of the sheets at a small distance rearwardly of the outlet side rerouting roller of the belt conveyor. The element for downward movement of the rear edges of the sheets can be a suction box to which suction can be applied and whose upper wall is parallel to the space below the conveyor plane and has suction openings. At the outlet of the sheet gate, two driven traction rollers can be arranged and can form cutting rollers. At inlet side, parts of the-sheet gate can be pivotally mounted for opening the gate in the direction of the blade drums. All of the elements at the beginning sheet transport device and which extend transversely across the machine width are mounted in a common carriage which is limitedly shiftable in and opposite to the sheet travel direction in the side walls of the frame of the sheet transport device.

The lower rapid conveyor can thus be formed to be as short as possible and with the minimum possible spacing from the lower drums. The structural length of the transport unit is thus extremely short. The capturing roller forms with the upper pass of the rapid belt conveyor, a clamping gap which converges in the feed direction and in which a new web leading end is reliably engaged.

Following the rapid belt conveyor there can be only a single further lower belt conveyor upon which the shingled stream of sheets is formed and which also serves to transport them up to the stacking unit.

BRIEF DESCRIPTION OF THE DRAWING

The drawing serves for explanation of the invention based upon a simple illustrated exemplary embodiment.

In the drawing.

MODE OF CARRYING OUT THE INVENTION

Figure 1:
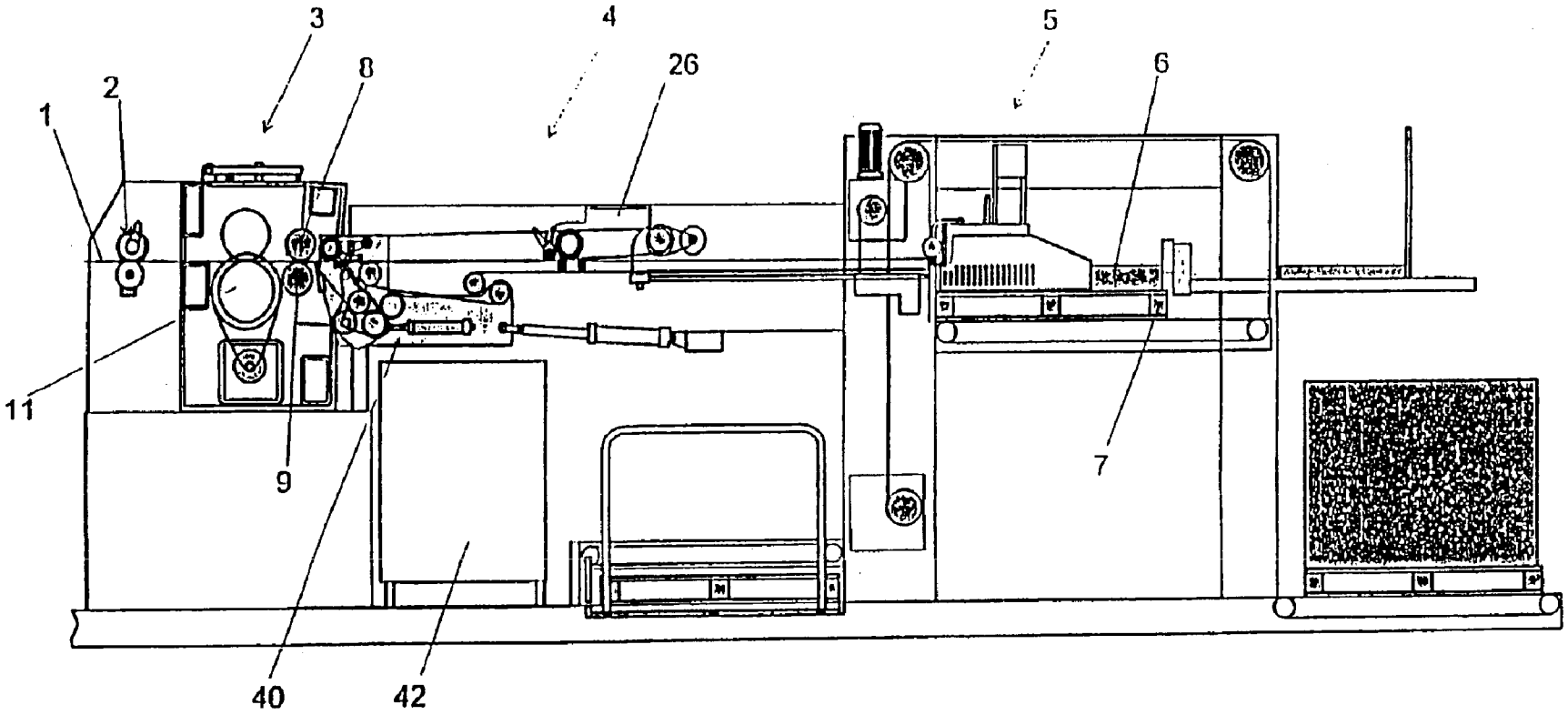
FIG. 1 a side view of a transverse cutting device.

The device illustrated in an overall elevational view in FIG. 1 serves for producing cardboard sheets from a continuously fed cardboard web 1. In the web-travel and sheet-travel direction (from left to right in the Figures), the following components are arranged one behind the other:

The longitudinal cutting device 2 in which the edges of the web 1 are trimmed and the web 1 is optionally subdivided into up to six individual strips, a cross-cutting device 3, a sheet transport unit 4 which takes up the sheets produced by cross-cutting and brakes them, whereby they form a shingled stream, and a stacking unit 5 in which the sheets supplied in the shingled stream are deposited on a stack 6 which rests upon a pallet 7.

The cross-cutting device 3 includes, in known manner, two blade drums 8 and 9 arranged one above the other, which are respectively fitted with at least one transverse blade 10 each. By the transverse blades 10, the web, as it passes by, is subdivided by a shear cut. A driven feed roll pair 11 rotatably mounted in the frame of the cross cutter 3 ahead of the blades 8, 9, feeds the web 1 to the blade drums 8, 9 with the desired sheet speed.

Figure 2:
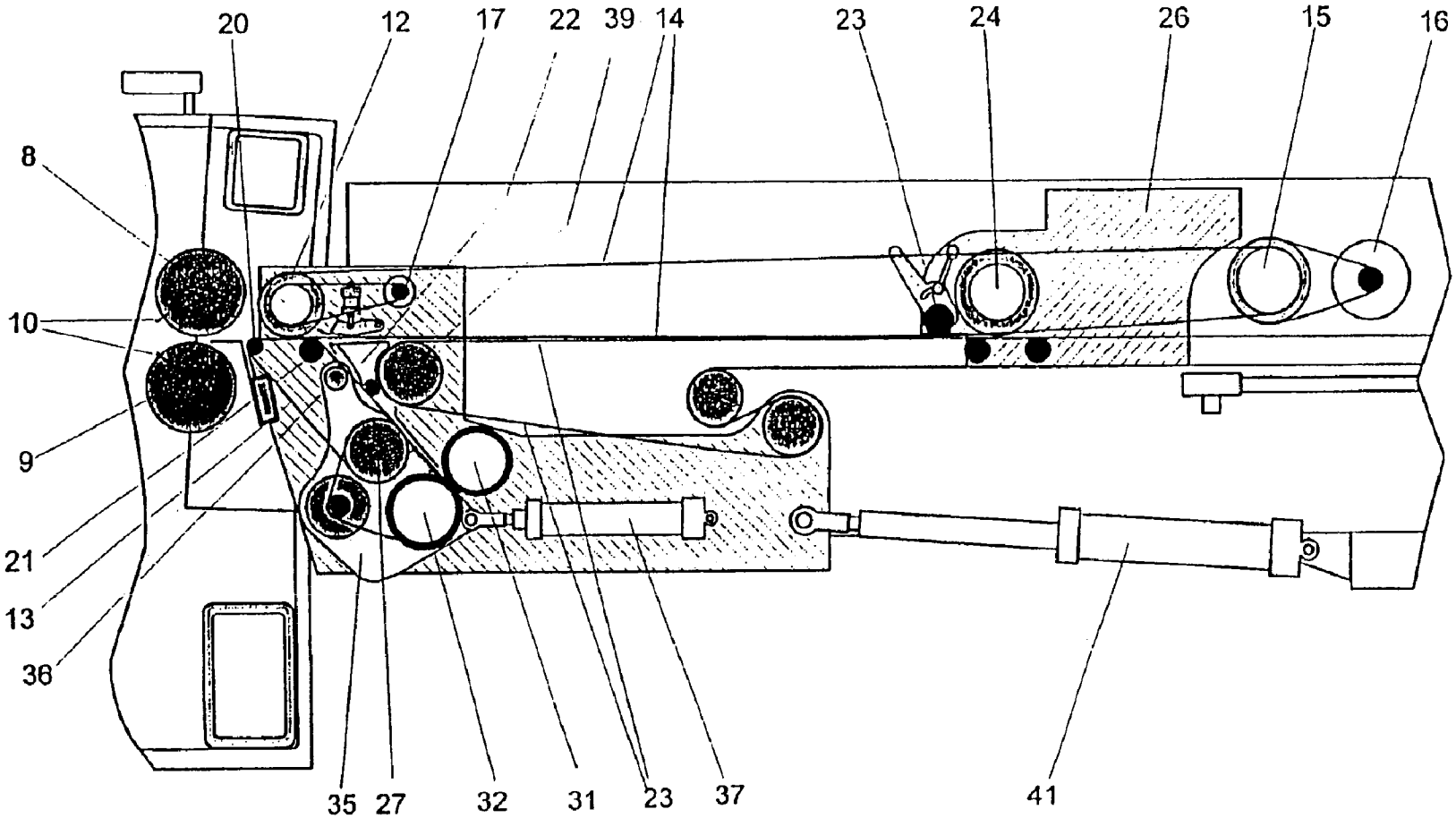
FIG. 2 the sheet transport device in an enlarged detail.

Directly behind the cross-cutting device 3, a sheet transport unit 4 is arranged and which has been illustrated in an enlarged form in FIG. 2. It contains elements for receiving the leading edges of the web produced by a cross cut and for pulling taut the web for cross cutting, for accelerating the further transport of sheets produced by cross cutting so as to form a gap between two sheets, and for braking a sheet to produce a shingled stream of overlapping sheets which is fed at a slowed-down transport speed of the stacking unit 5.

The sheet transport device 4 begins with the device for receiving the leading edge of the web and for accelerating the sheet produced by a cross cut. This device is comprised of an upper capturing roller 12 (FIG. 3) which reaches from above substantially into the feed plane and an associated lower rapid belt conveyor 13. The capturing roller 12 is simultaneously the inlet side rerouting roller of a rapid upper belt conveyer 14 which is comprised of a plurality of parallel but spaced-apart belts which extend at least over the region of the maximum sheet size length. At the outlet side, the upper belt 14 is deflected around a rerouting roller 15 driven by a rotary drive 16 (FIG. 2). So that a gap will be formed between two sheets, the rapid upper belt 14 is driven with a speed which is higher than the speed of the web. The capturing roller 12 is also driven with this increased speed. So that its peripheral position can match different cardboard thicknesses, the capturing roller 12 is journaled eccentrically in lateral bearing shells which can be adjusted by means of a rotary drive 17. A rotation of the bearing shells effects a lifting or lowering of the capturing roller 12.

The lower belt conveyor 13, which is comprised of one machine-wide belt or a plurality of parallel belts, is so arranged below the capturing roller 12 that its upper pass 18 forms a clamping gap in the inlet plane of the forward edges of the sheets with the capturing roller 12. In the clamping gap or nip, an oncoming web edge is received and a tractive force exerted upon it to stretch the web 1 during cross cutting. The sheets produced by the cross cut are then transported further with enhanced speed. A guide plate 19 (FIG. 3) arranged in the feed plane between the blade drums 8, 9 and the belt conveyor 13 supports the leading edge of the web until it is taken up by the belt conveyor 13. The belt conveyor 13 is driven with the increased speed of the upper belt conveyor 14. The belt leading edge traveling in the feed plane and the sheet formed therefrom are received by the displacing pass 18 from an inlet side rerouting roller 20 to an outlet side rerouting roller 21.

At a short distance behind the rerouting roller 21, the braking and overlapping device begins with an element producing a downward movement of the rear edge of the sheet. Preferably the element is comprised of a suction box 22 subjected to underpressure and whose upper wall is parallel to and somewhat spaced below the conveyor plane and which is provided with auction openings. Preferably suction is applied continuously during the operation and not in a periodically interrupted manner. The suction draws upon the rear edge of the sheet and brakes it. The downward movement of the rear edge of the sheet can also be effected by aerodynamically active baffle plates as has been described, for example, in DE-A-265 01 081.

In conjunction with the element for the downward movement of the rear edges of the sheets, a lower belt conveyor 23 is provided up to the stacking device 5. The lower belt conveyer 23 travels with the slower deposition speed. With it the sheets are deposited on the stack 6. The value of the deposition speed amounts to about 20% of the web speed at cross cutting, for example about 80 m/min. During the braking of a sheet, the front edge of a following sheet still traveling more rapidly, shifts over the rear edge of the braked sheet. Thus a shingled stream of mutually overlapping sheets results which is carried away with the slower deposition speed on the lower belt 23.

To reliably feed a sheet during the braking in the overlapping region at its upper side, it suffices to have the lower pass of the upper belt 14 extend at least over the length of the sheet size. At the outlet side, the effective conveyor stretch is bounded by a stationary guide tube 24 which is adjustable as to its height and which braces the lower pass of the upper belt 14 on its back side and in addition reroutes it upwardly from the conveyor stretch to the rerouting roller 15. Directly behind the guide tube 24, between the upper belts 14 and circumferentially below them are capturing rollers 25 which are freely journaled on a common axis. The capturing rollers 25 press the leading edges of an incoming sheet away from the rapidly traveling upper belts downwardly onto the slower lower belt 23. They form with the lower belt 23 a clamping gap through which the shingled stream of sheets is fed.

Since the position of the guide tube 24 and the capturing rollers 25 must be matched to the sheet length, these elements are journaled in a carriage 26 which can be adjustable over the requisite range in and opposite to the sheet travel direction.

The outlet side rerouting roller 21 of the belt conveyor 13 is spaced by a distance less than the maximum sheet length, preferably less than the minimum sheet length, from the axes of rotation of the blade drums 8, 9 and serves simultaneously as an ejection roller for the subsequently arranged braking and overlapping unit. An ejection roller guides a sheet into a subsequent stretch portion in which it briefly, for at least an instant, is not engaged as it travels, i.e. is free. The invention thus provides immediately following the deflection roller 21, a stretch in which at the beginning no conveyor means engages the underside of a sheet and in which the spacing between the upper and lower conveyor elements is greater than the thickness of the sheet found between them. At the outlet side, the stretching region is bounded by the capturing roller 24 without gripping of the sheet and which forms a clamping gap with the slower lower belt 23 through which the shingled stream is guided. The spacing of the capturing roller 24 from the outlet side rerouting roller 21 thus amounts to at least an actual sheet size length.

Figure 3:
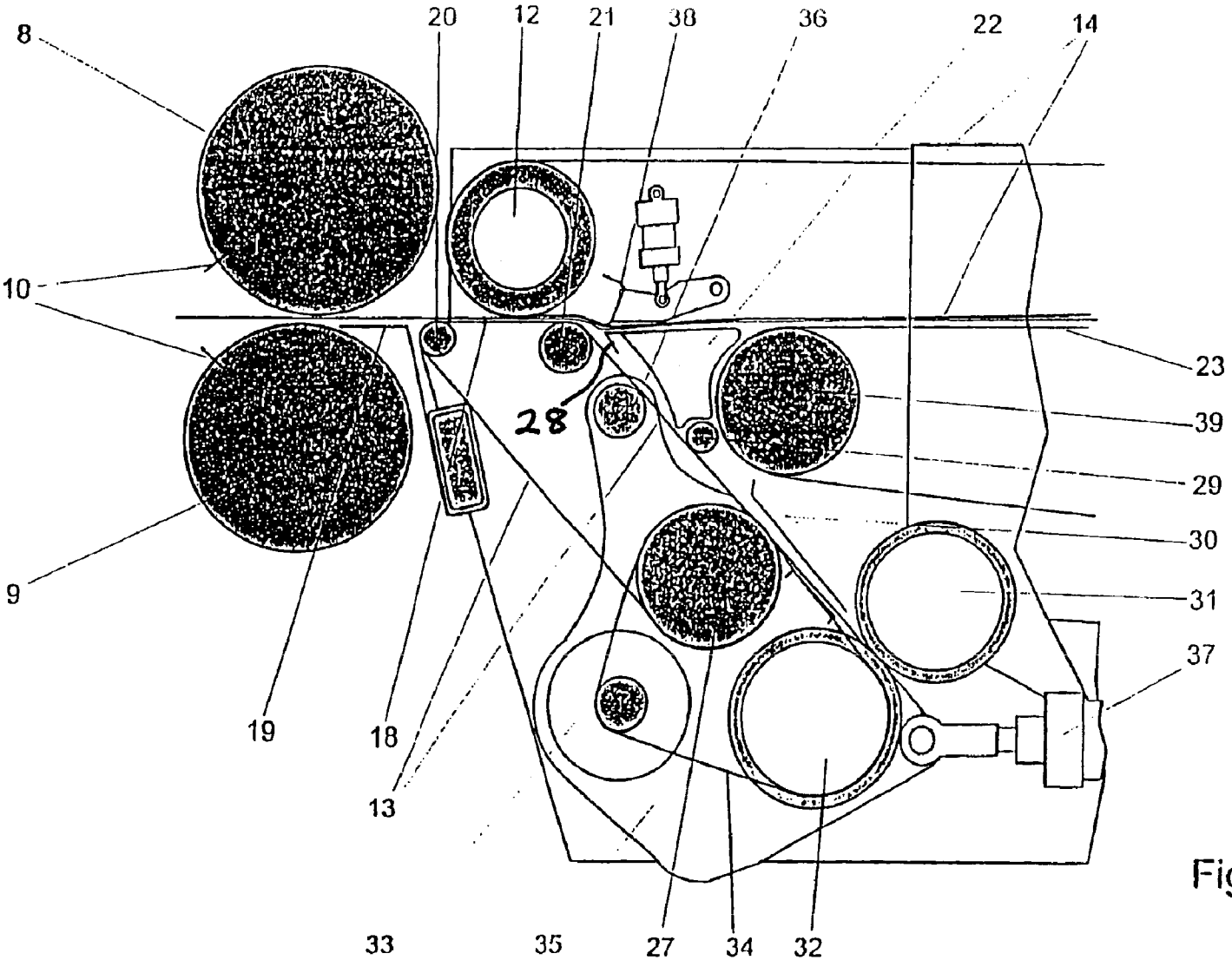
FIG. 3 is a side view in section of the region of the sheet gate.

A sheet gate is arranged between the outlet side rerouting roller 21 of the rapid belt conveyor 13 and the suction box 22 and has been shown enlarged in FIG. 3. The sheet gate serves to eject damaged sheets, especially sheets which have splices therein.

To form the gate, the rerouting roller 21 deflects the belt of the belt conveyor 13 at an inclination downwardly to a further rerouting roller 27 from which it returns to the inlet side rerouting roller 20. The rerouting roller 21 thus forms a boundary of the inlet of the sheet gate and the belt conveyor 13 advantageously also serves as the conveyor in the sheet gate. At the outlet side, the inlet to the gate is bounded by a guide plate 28 which is fastened on the suction chamber 22. A further guide roller 29 below the suction box 22 and a subsequent guide plate 30 form together with the belt 13 a guide for the ejected sheet traveling to two driven traction rollers 31, 32 at the gate outlet from which the ejected sheet is withdrawn from the cross-cutting machine.

Preferably the front traction roller 32 and the belt conveyor 13 have a common drive. In the present example, the common drive is an electric motor 33 which drives a belt 34 passing around the rerouting roller 27 and the traction roller 32. To allow the gate to be opened for dust removal, the two rollers 27 and 32 are journaled on each longitudinal side of the machine respectively on a swingable side part 35 and the drive 33 is also fastened on one of the side parts 35. The pivot axis 36 of the side parts 35 is located somewhat below the rerouting roller 21 so that the inlet side of the gate can be moved by a piston-cylinder unit 37 in a direction toward the blade drums 8 and 9 for opening. Above the conveyor plane, in the region of the gate inlet, between the capturing roller 12 and the suction box 22, a pneumatically actuatable gate flap 38 is arranged by means of which the deflection of a sheet downwardly into the gate by movement in the conveyor plane can be effected. The active position of the gate flap 38 is shown in FIG. 3.

In a preferred embodiment, the two driven traction rollers 31 and 32 are configured as slicing rollers with rotating cutting rings. An ejected sheet upon passage between the two traction rollers 31, 32 is comminuted into pieces which are fed to a container arranged below the gate outlet. The slicer for the ejected sheets is thus advantageously integrated in the sheet gate and does not require any drive for itself.

All of the elements at the beginning of the sheet transport device and which extend transversely across the machine width, thus the upper capturing roller 12 with its adjustment device 17, the lower rapid belt conveyor 13, the sheet gate, the suction box 22 and the inlet side rerouting roller 39 of the slow lower belt conveyor 23 are mounted in a common carriage 40 (FIG. 1). The carriage 40 is shiftable in and opposite to the sheet travel direction in the side wall of the frame of the sheet transport device 4. The shifting of the carriage 40 is effected by means of laterally disposed piston-cylinder units 41 which can draw the carriage from its working position as close as possible to the transverse cutting device into a position spaced therefrom and in which the region between the cross cutter 3 and the sheet transport 4 is open. This permits a jam to be removed at the transverse cutter 3 as well as at the inlet of the arc transport device 42.

What is claimed is:

1. An apparatus for cross-cutting a cardboard web, comprising:

a web feeder for feeding a cardboard web to the apparatus;

a cross-cutter device positioned to receive said web from said feeder and provided with two blade drums having transverse blades for shearing said web across a width thereof into a succession of sheets; and a sheet transport device downstream of said cross-cutter device in a direction of displacement of said web and said sheets and including:

a lower belt conveyor having an upper pass extending between an upstream rerouting roller positioned to receive said sheets from said cross-cutter device and a downstream rerouting roller bounding a discharge gate, and a downwardly inclined pass beginning at said downstream rerouting roller and forming a conveyor of sheets in said discharge gate, said upper pass accelerating said sheets away from said cross-cutter device, and a brake downstream of said upper pass for slowing said sheets so that subsequent sheets overlap previous sheets to form a shingled series of said sheets, said brake being spaced from said downstream rerouting roller whereby said downstream rerouting roller and said upper pass free said sheets for travel over a path region in which said sheets are not engaged;

a deflector for selectively deflecting a sheet to be discharged into said discharge gate;

a further conveyor for displacing said shingled series of sheets in said direction of displacement; and a carriage shiftable in said direction of displacement, said lower belt conveyor, said brake and said deflector being mounted on said carriage, and a piston-and-cylinder unit connected with said carriage for displacing said carriage between an operating position close to said cross-cutter device and another position spaced away from said cross-cutter device.

2. The apparatus defined in claim 1, wherein said downstream rerouting roller is spaced from rotation axes of said blade drums by a distance less than a maximum sheet length in said direction of displacement.

3. The apparatus defined in claim 1 wherein said distance is less than a minimum sheet length in said direction of displacement.

4. The apparatus defined in claim 1, further comprising a capturing roller above said upper pass and forming a clamping nip with said upper pass of said lower belt conveyor.

5. The apparatus defined in claim 4 wherein said capturing roller is an inlet side rerouting roller of an upper belt conveyor extending above said upper pass over a length in said direction of displacement at least equal to a maximum sheet length.

6. The apparatus defined in claim 5 wherein said further conveyor is a belt conveyor slower than the lower belt conveyor having said upper pass and extending in said direction of displacement to a stacking device, said apparatus further comprising a capturing roller above said further conveyor forming a clamping gap with said further conveyor and defining an end of a path of the sheets in which the sheets are not gripped.

7. The apparatus defined in claim 6 wherein said brake is a suction box having an upper wall parallel to a conveyor plane in which said sheets travel and formed with suction openings.

8. The apparatus defined in claim 1, further comprising two driven traction rollers at an outlet of said gate discharge and formed as cutting rollers.

9. The apparatus defined in claim 1, further comprising means pivotally mounted to open said gate toward said blade drums at an inlet to said discharge gate.

* * * * *